US008577270B2

(12) United States Patent
Hirose et al.

(10) Patent No.: US 8,577,270 B2
(45) Date of Patent: Nov. 5, 2013

(54) FUSING DEVICE AND IMAGE FORMING APPARATUS INCLUDING THE SAME

(75) Inventors: Fumihiro Hirose, Kanagawa (JP); Takeshi Yamamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 290 days.

(21) Appl. No.: 12/980,830

(22) Filed: Dec. 29, 2010

(65) Prior Publication Data

US 2011/0164904 A1 Jul. 7, 2011

(30) Foreign Application Priority Data

Jan. 7, 2010 (JP) ..... 2010-001897

(51) Int. Cl.
*G03G 15/20* (2006.01)

(52) U.S. Cl.
USPC ..... 399/323; 271/309; 219/216

(58) Field of Classification Search
None
See application file for complete search history.

(56) References Cited

U.S. PATENT DOCUMENTS

| | | | | |
|---|---|---|---|---|
| 2004/0120735 | A1* | 6/2004 | Baba et al. | 399/323 |
| 2006/0257183 | A1 | 11/2006 | Ehara et al. | |
| 2007/0217841 | A1* | 9/2007 | Fujii | 399/341 |
| 2008/0063441 | A1* | 3/2008 | Burton et al. | 399/323 |
| 2009/0087234 | A1* | 4/2009 | Roof et al. | 399/323 |
| 2009/0274492 | A1* | 11/2009 | Ishikawa | 399/323 |
| 2009/0297199 | A1 | 12/2009 | Yamashina et al. | |
| 2010/0239292 | A1 | 9/2010 | Fujita et al. | |

FOREIGN PATENT DOCUMENTS

| | | |
|---|---|---|
| CN | 101570285 A | 11/2009 |
| JP | 51-104350 | 9/1976 |
| JP | 55-73956 | 5/1980 |
| JP | 56-119162 | 9/1981 |
| JP | 60-247672 | 12/1985 |
| JP | 61-59468 | 3/1986 |
| JP | 2581429 | 7/1998 |
| JP | 2005-49647 | 2/2005 |
| JP | 2005-157179 | 6/2005 |
| JP | 2005-258035 | 9/2005 |
| JP | 2007-71955 | 3/2007 |
| JP | 2007-79411 | 3/2007 |
| JP | 2007-199462 | 8/2007 |
| JP | 2007-240920 | 9/2007 |
| JP | 2007-240921 | 9/2007 |

OTHER PUBLICATIONS

Combined Chinese Office Action and Search Report issued Nov. 27, 2012 in Chinese Patent Application No. 201110043623.3 (with English-language translation).
Japanese Patent Office (2010-001897) dated Jul. 16, 2013.

* cited by examiner

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

A fusing device includes a rotary fusing part; a heating unit heating the rotary fusing part; a rotary pressure part pressed against the rotary fusing part; nozzles jetting compressed air to paper being conveyed through a nip between the rotary fusing part and the rotary pressure part; and separating parts guiding the paper separated from the rotary fusing part. The nozzles and the separating parts are disposed downstream of the nip in a paper conveying direction so as not to contact the rotary fusing part and the rotary pressure part and are arranged alternately along the length direction of the nip that is orthogonal to the paper conveying direction. The separating parts protrude beyond the tips of the nozzles toward the nip.

20 Claims, 9 Drawing Sheets

FUSING DEVICE AND IMAGE FORMING APPARATUS INCLUDING THE SAME

BACKGROUND OF THE INVENTION

1. Field of the Invention

A certain aspect of the present invention relates to a fusing device and an image forming apparatus.

2. Description of the Related Art

An image forming apparatus such as a copier, a printer, a facsimile machine, or a multifunction peripheral having functions of those apparatuses generally includes a fusing device for fusing a toner image transferred onto a recording medium (hereafter may be called "paper" but not limited to a sheet of paper). A heat roller fusing device, which is widely used as the fusing device, includes a fusing roller including a heat source such as a halogen heater and a pressure roller pressed against the fusing roller. Paper with an unfused toner image is heated and pressed while being conveyed through a nip formed between the fusing roller and the pressure roller.

There is another type of fusing device called a belt fusing device. A belt fusing device includes a heating roller including a heat source such as a halogen heater, a fusing roller, an endless fusing belt stretched over the heating roller and the fusing roller, and a pressure roller pressed against the fusing roller via the fusing belt. Paper with an unfused toner image is heated and pressed while being conveyed through a nip formed between the fusing belt and the pressure roller. Since a fusing belt has a comparatively low heat capacity, a belt fusing device makes it possible to reduce the warming-up time and to save energy.

The heat roller fusing device and the belt fusing device as described above are called heat fusing devices. In a heat fusing device, the fusing roller or belt that contacts a toner image fused onto paper is coated with fluoroplastic having excellent release characteristics and a separating claw is provided to separate the paper from the fusing roller or belt. The separating claw contacts the fusing roller or belt and therefore tends to scratch the surface of the fusing roller or belt. Such a scratch, for example, results in an undesired stripe in a formed image.

In the case of a monochrome image forming apparatus, the fusing roller is typically made of a Teflon®-coated metal roller that is not easily damaged even when the separating claw touches its surface and has a long service life. Therefore, in such a monochrome image forming apparatus, a separating claw is popularly used to prevent a "paper-winding jam" where paper winds around the fusing roller and gets stuck. Meanwhile, in a color image forming apparatus, to improve the color development, the surface layer of a fusing roller or belt is typically made of fluorine-coated silicone rubber (e.g., a PFA tube with a thickness of several tens μm) or silicone rubber on which oil is applied. However, a surface layer made of such a material is soft and easily scratched. Such a scratch on the surface layer results in an error such as an undesired stripe in a fused image. Therefore, in a color image forming apparatus, a noncontact separating method is preferably used instead of a contact separating method using, for example, a separating claw.

With a noncontact separating method, if the adhesion between toner (toner image) and the fusing roller is strong, paper with a fused toner image easily winds around the fusing roller and causes a paper-winding jam. Particularly, when forming a multicolor image, the adhesion between a toner image and the fusing roller increases because multiple toner layers of different colors are stacked to form the toner image and this in turn increases the chance of the paper-winding jam. Currently, the following noncontact separating methods are mainly used:

(1) Noncontact Separating Plate Method

In this method, a separating plate extending in the length or width direction of the fusing roller or belt is used. The separating plate is disposed in parallel with the fusing roller or belt, and a minute gap (about 0.2-1 mm) is provided between the separating plate and the fusing roller or belt.

(2) Noncontact Separating Claw Method

In this method, multiple separating claws arranged at predetermined intervals are used. A minute gap (about 0.2-1 mm) is provided between the separating claws and the fusing roller or belt.

(3) Self-Stripping Method

In this method, the fusing device is configured such that paper naturally or automatically separates from the fusing roller or belt due to the elasticity of the paper and the curvature of the fusing roller or belt.

However, the above methods have problems as described below. With any one of the methods (1) through (3), a gap is present between the fusing roller or belt and a guide plate guiding paper to the exit of the fusing unit. For example, thin paper, paper with a small top margin, or paper with a solid image such as a photograph may pass through the gap without being separated from the fusing roller or belt and may cause a paper-winding jam. Also, with the methods (1) and (2), paper may get stuck at the separating plate or the separating claws and cause a paper jam.

To solve or reduce the above problems of noncontact separating methods, it is proposed to jet air to a paper-separating position. For example, Japanese Patent Application Publications No. 61-59468, No. 2007-079411, and No. 2007-240920 disclose methods for jetting air to a paper-separating position.

In a configuration disclosed in JP61-59468, a separating claw is provided near a fusing roller and an air outlet for jetting air to the leading edge of paper adhering to the fusing roller is provided at the tip of the separating claw.

JP2007-079411 discloses a configuration including a support part having a hole for allowing air to pass through and jetting parts each having a jetting hole for jetting air to the leading edge of paper. The jetting parts are supported by the support part and can rotate independently from each other. This configuration makes it possible to change air-jetting directions of the jetting parts according to the shape of paper.

In a configuration disclosed in JP2007-240920, compressed air is jetted from an air nozzle to the leading edge of paper that has just passed through a nip of a fusing device to separate the paper from a fusing roller. Also in the disclosed configuration, when paper sheets are consecutively conveyed to fuse toner images onto the paper sheets, compressed air is consecutively jetted onto the outer surface of the fusing roller at positions between the paper sheets being conveyed. This configuration prevents causing temperature differences on the outer surface of the fusing roller and thereby prevents causing uneven glossiness on the paper sheets.

In the configuration of JP61-59468, the air outlet is formed at a position slightly apart from the tip of the separating claw. Still, however, when paper with a small basis weight carries a large amount of unfused toner, the paper may contact the separating claw after going through the nip and being separated from the fusing roller, and the toner adheres to the separating claw. The adhering toner may prevent smooth conveyance of paper, cause an undesired stripe in an image, or block the air outlet. Such adhering toner cannot be easily removed.

In JP2007-079411, a separating part functioning as a paper separating plate and the jetting hole are integrated as the jetting part. With this configuration, the smooth flow of air is prevented if the gap between the jetting part and a fusing roller is reduced. In the configuration disclosed in JP2007-240920, a guide part is disposed to protrude from the air nozzle toward the nip and the paper separated from the fusing roller is guided by the guide part so as not to touch the air nozzle. The air nozzle has a horizontal opening with a length greater than the length of the fusing roller and configured to cool the entire length of the outer surface of the fusing roller. However, since the main object of this configuration is to prevent uneven glossiness on paper sheets being conveyed consecutively, no further mechanism is provided to reliably separate paper from the fusing roller. Particularly in the case of a high-speed color image forming apparatus, the performance of the guide part used as a separating plate in separating paper from the fusing roller improves as the gap between the fusing roller and the guide part decreases. However, if the gap between the fusing roller and the guide part extending in the length direction of the fusing roller is reduced excessively, the flow of air jetted to the entire length of the fusing roller may be blocked and the performance of the air nozzle in separating paper from the fusing roller may be reduced.

SUMMARY OF THE INVENTION

In an aspect of this disclosure, there is provided a fusing device that includes a rotary fusing part; a heating unit heating the rotary fusing part; a rotary pressure part pressed against the rotary fusing part; nozzles jetting compressed air to paper being conveyed through a nip between the rotary fusing part and the rotary pressure part; and separating parts guiding the paper separated from the rotary fusing part. The nozzles and the separating parts are disposed downstream of the nip in a paper conveying direction so as not to contact the rotary fusing part and the rotary pressure part and are arranged alternately along the length direction of the nip that is orthogonal to the paper conveying direction. The separating parts protrude beyond the tips of the nozzles toward the nip.

DESCRIPTION OF THE PREFERRED EMBODIMENTS

Preferred embodiments of the present invention are described below with reference to the accompanying drawings.

Figure 1:
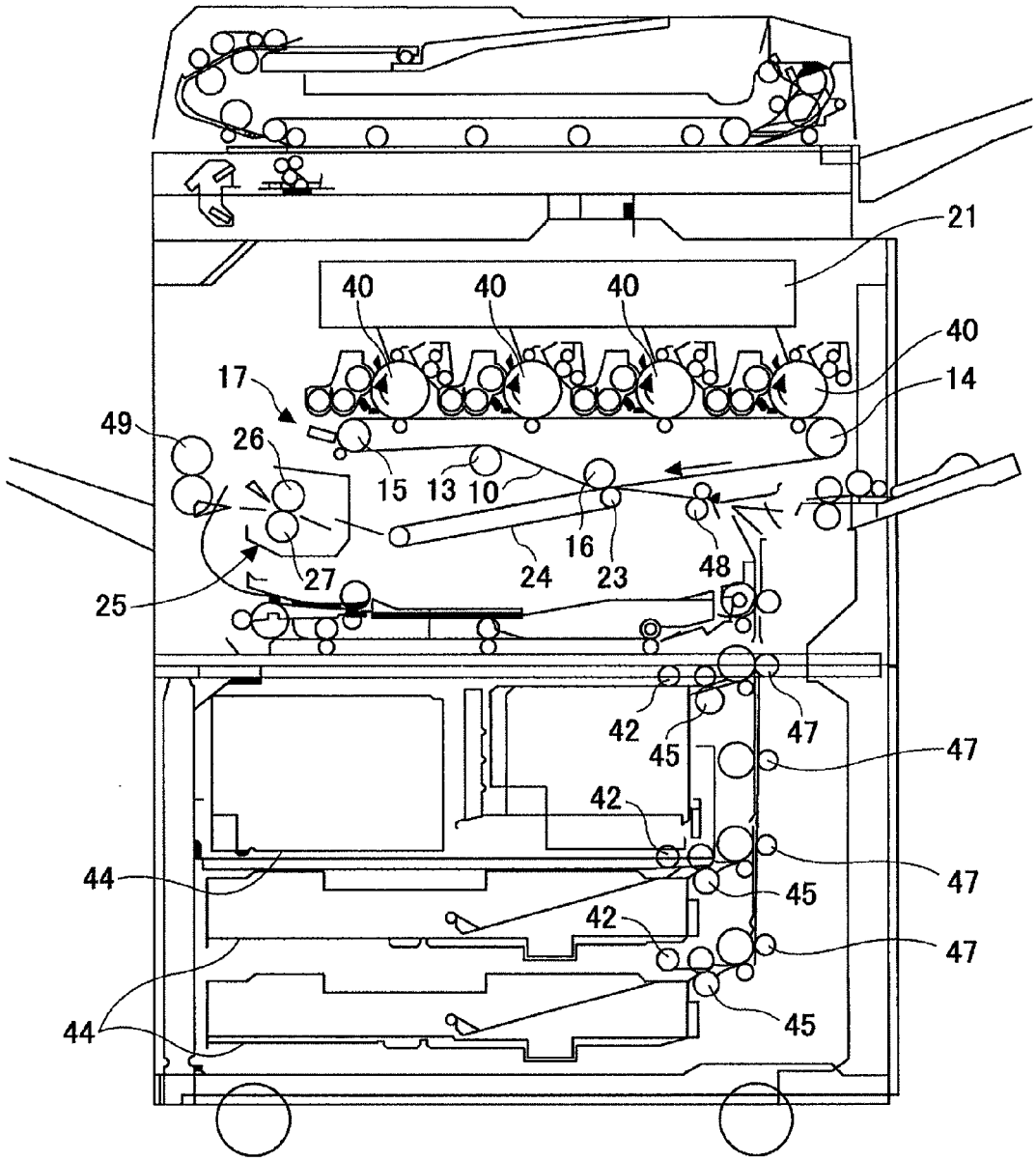
FIG. 1 is a schematic diagram of an image forming apparatus.

FIG. 1 is a schematic diagram of an image forming apparatus according to an embodiment of the present invention. In this embodiment, the image forming apparatus is implemented as a copier employing a tandem indirect (intermediate) transfer method. An endless intermediate transfer belt (intermediate transfer part) 10 is provided in the center of the image forming apparatus. The intermediate transfer belt 10 is stretched over support rollers 13, 14, 15, and 16 and can be rotated clockwise in FIG. 1.

An intermediate transfer belt cleaning unit 17 for removing toner remaining on the intermediate transfer belt 10 after image transfer is provided to the left of the support roller 15. The toner removed by the intermediate transfer belt cleaning unit 17 is conveyed by a conveying part (not shown) and caused to fall into a toner collecting bottle (not shown) by gravity. A detecting unit for detecting the amount of collected toner is provided in the toner collecting bottle to stop the image forming apparatus when the toner collecting bottle becomes full and thereby to prevent overflow of toner from the toner collecting bottle.

Four image forming units corresponding to black, magenta, cyan, and yellow are arranged side by side along a paper conveying direction above the intermediate transfer belt 10. The four image forming units constitute a tandem image forming unit. An exposing unit 21 is provided above the tandem image forming unit.

A secondary transfer roller 23 of a secondary transfer unit is disposed to face the support roller 16 disposed below a lower center part of a loop formed by the intermediate transfer belt 10. A fusing unit (fusing device) 25 for fusing a toner image onto paper is provided downstream of the secondary transfer unit in the paper conveying direction. The fusing unit 25 includes a fusing roller 26 used as a fusing part and a pressure roller 27 used as a pressure part and pressed against the fusing roller 26.

When a start switch (not shown) is pressed, one of the support rollers 14, 15, and 16 is rotated by a drive motor (not shown) to rotate the intermediate transfer belt 10 and other support rollers (including the support roller 13) are rotated by the rotation of the intermediate transfer belt 10. Meanwhile, photoconductors 40 in the respective image forming units are rotated and single-color images of black, magenta, cyan, and yellow are formed on the photoconductors 40. The single color images are transferred sequentially and superposed onto the intermediate transfer belt 10 being rotated to form a multicolor image on the intermediate transfer belt 10.

Also when the start switch is pressed, one of paper-feed rollers 42 of a paper feeding unit is rotated to feed paper from the corresponding one of paper-feed cassettes 44 in a paper bank. Sheets of paper are separated by a separating roller 45 and fed one by one into a paper-feed path. Then, the paper is conveyed by conveying rollers 47 into a paper-feed path in the main unit (that includes the tandem image forming unit) and is stopped at a resist roller 48. The resist roller 48 is rotated in synchronization with the movement of the multicolor toner image on the intermediate transfer belt 10 to feed the paper into a gap between the intermediate transfer belt 10 and the secondary transfer roller 23 and thereby to transfer the multicolor toner image onto the paper.

The paper with the transferred multicolor toner image is conveyed by a belt 24 of the secondary transfer unit into the fusing unit 25. After the toner image is fused onto the paper by the fusing unit 25 applying heat and pressure, the paper is ejected by an ejection roller 49 onto a paper-catch tray. Meanwhile, after the multicolor toner image is transferred from the intermediate transfer belt 10, toner remaining on the intermediate transfer belt 10 is removed by the intermediate transfer belt cleaning unit 17 to prepare for the next image forming process by the tandem image forming unit.

Figure 2:
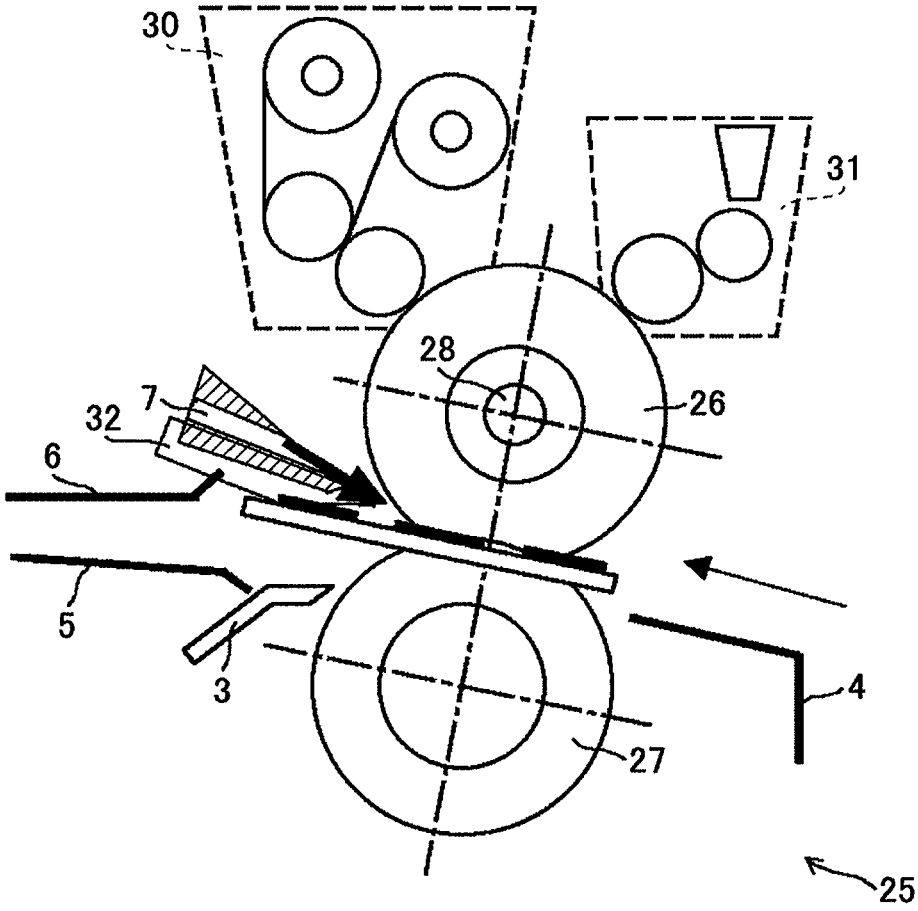
FIG. 2 is a schematic diagram of a roller fusing unit including an air separating mechanism.

Next, the fusing unit 25 is described in more detail with reference to FIG. 2. A fusing heater (heat source) 28 is provided inside of the fusing roller 26 to heat the fusing roller 26. The fusing roller 26 is rotated by a drive mechanism (not shown) and the pressure roller 27 is rotated by the rotation of the fusing roller 26. Alternatively, the pressure roller 27 may also be rotated by a drive mechanism. A temperature sensor (not shown) detects the surface temperature of the fusing roller 26 and a temperature control unit (not shown) controls the fusing heater 28 based on an output signal from the temperature sensor to maintain the surface temperature of the fusing roller 26 at a predetermined temperature. Paper with an unfused toner image is conveyed into the fusing unit 25. In the fusing unit 25, the paper passes through a nip between the pressure roller 27 and the fusing roller 26 maintained at the predetermined temperature and as a result, the toner image is fused onto the paper. Thereafter, the paper is conveyed out of the fusing unit 25.

The fusing unit 25 also includes nozzles 7, a web cleaning unit 30 for cleaning the fusing roller 26, an oil applying unit 31 for applying oil to the fusing roller 26, and separating parts 32. In this embodiment, the web cleaning unit 30 and the oil applying unit 31 are provided only for the fusing roller 26. However, a web cleaning unit and an oil applying unit may also be provided for the pressure roller 27. Further, an entrance guide 4 is provided at the entrance of the fusing unit 25, exit guides 5 and 6 are provided at the exit of the fusing unit 25, and a separating plate 3 is disposed to face the pressure roller 27.

Figure 3:
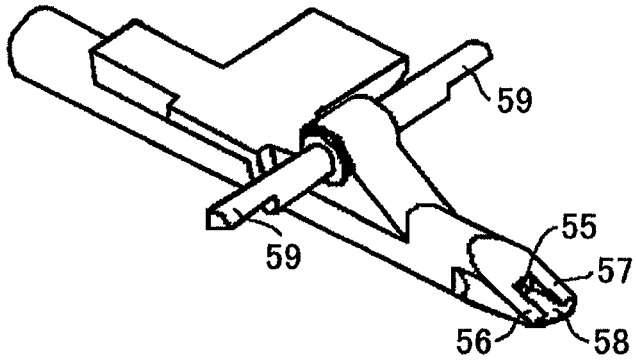
FIG. 3 is a perspective view of a nozzle with pins.
Figure 4:
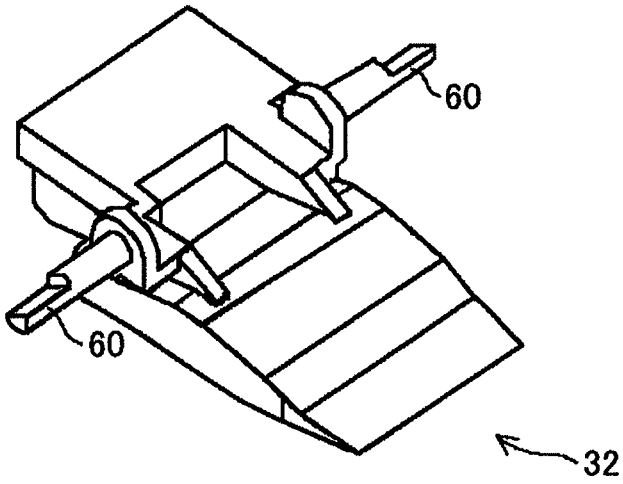
FIG. 4 is a perspective view of a separating part with pins.

FIG. 3 shows a configuration of the nozzle 7. The nozzle 7 includes an air outlet 55; and a right protective wall 56, a left protective wall 57, and a bottom protective wall 58 surrounding the air outlet 55 on three sides. The nozzle 7 may be made of perfluoro-alkoxyfluoro plastics (PFA) or the surface of the nozzle 7 may be coated with PFA. Also, any other fluoroplastic such as polytetrafluoroethylene (PTFE) may be used for the nozzle 7. The nozzle 7 also includes horizontal pins 59. FIG. 4 shows a configuration of the separating part 32. The separating part 32 also includes horizontal pins 60.

Figure 5:
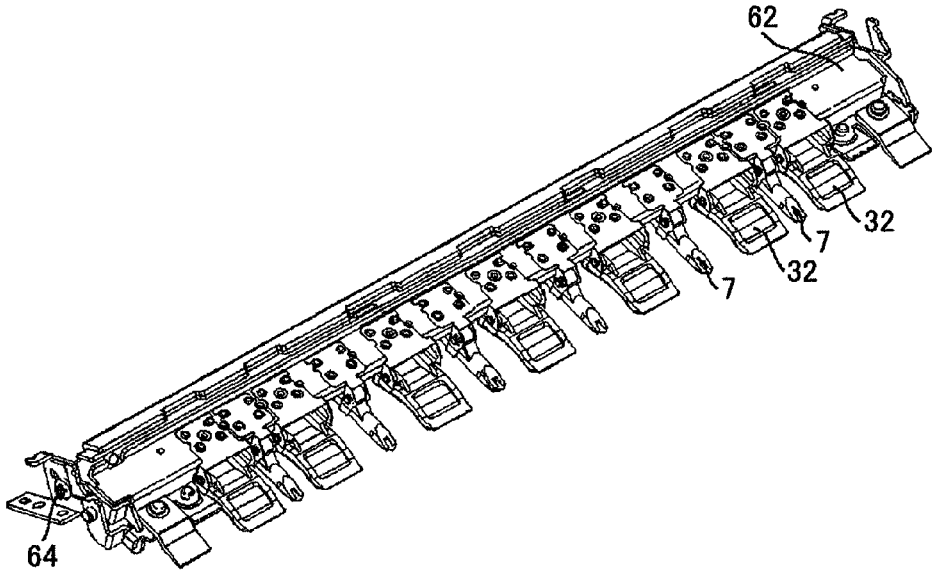
FIG. 5 is a drawing illustrating separating parts and nozzles mounted on a stay.
Figure 6:
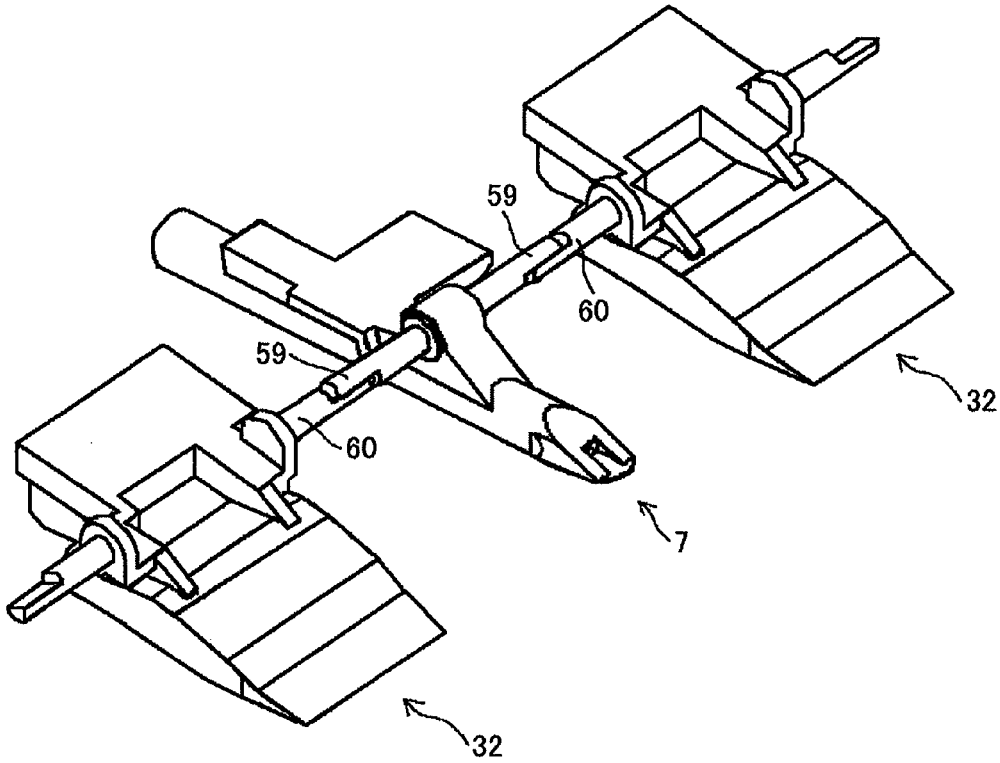
FIG. 6 is a drawing illustrating nozzles and separating parts connected to each other.
Figure 7:
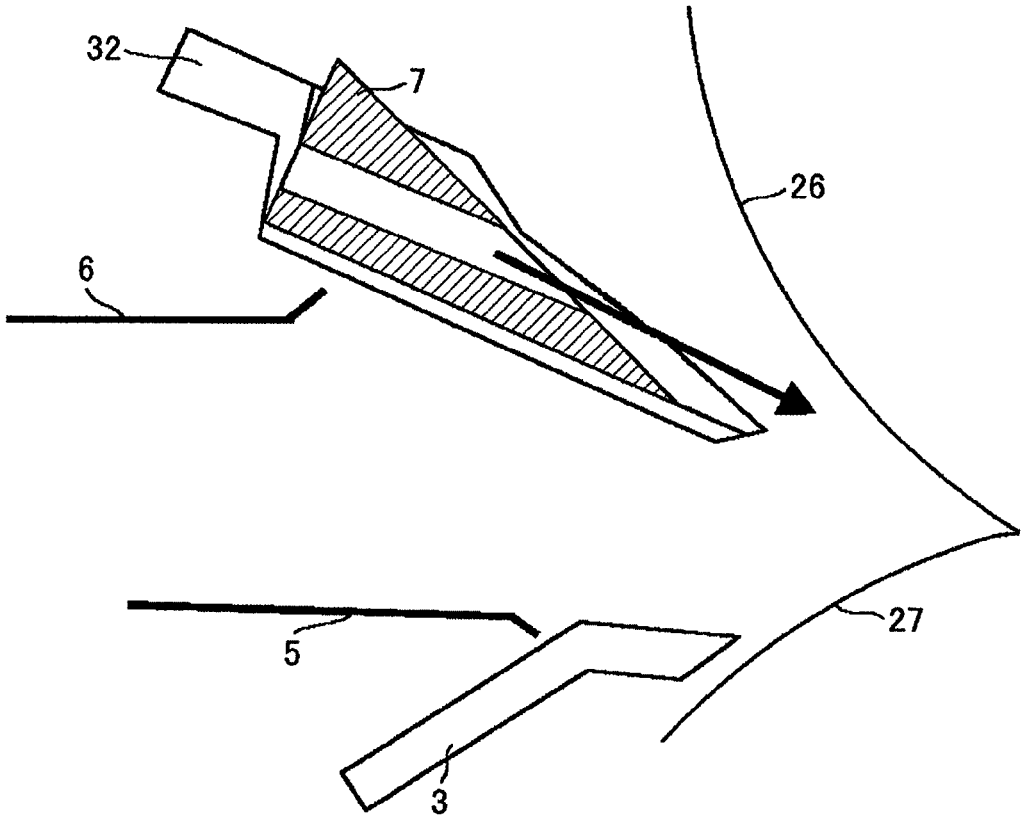
FIG. 7 is a drawing illustrating an exit of a fusing unit.
Figure 8:
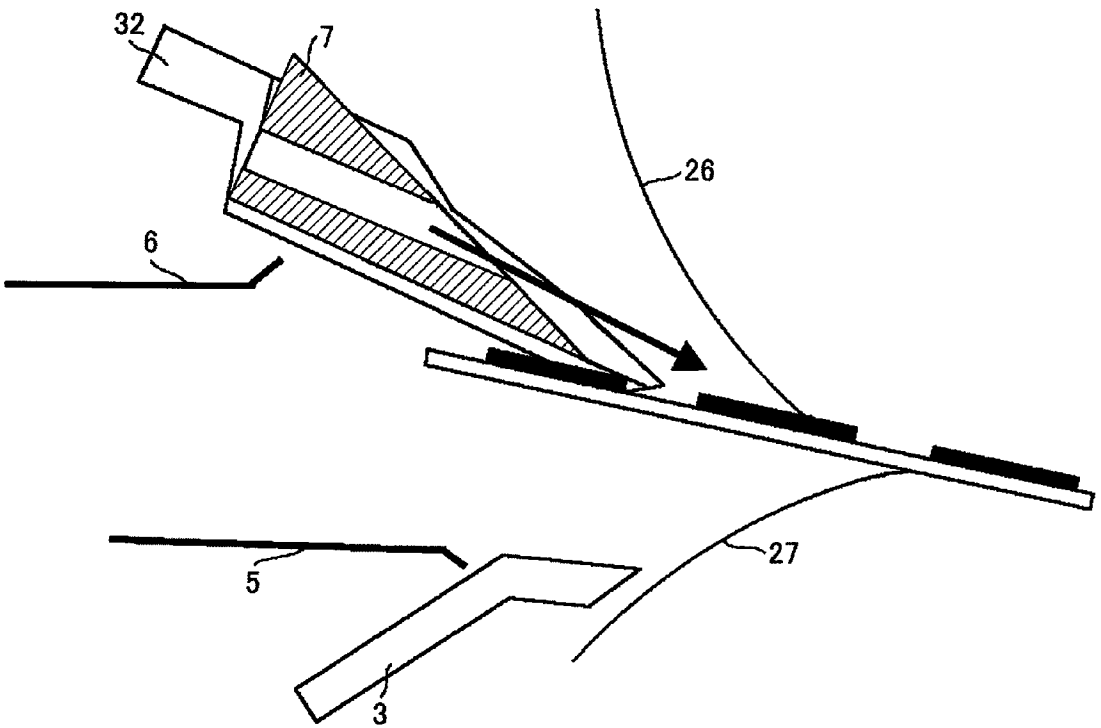
FIG. 8 is a drawing illustrating paper contacting an air separating mechanism.
Figure 9:
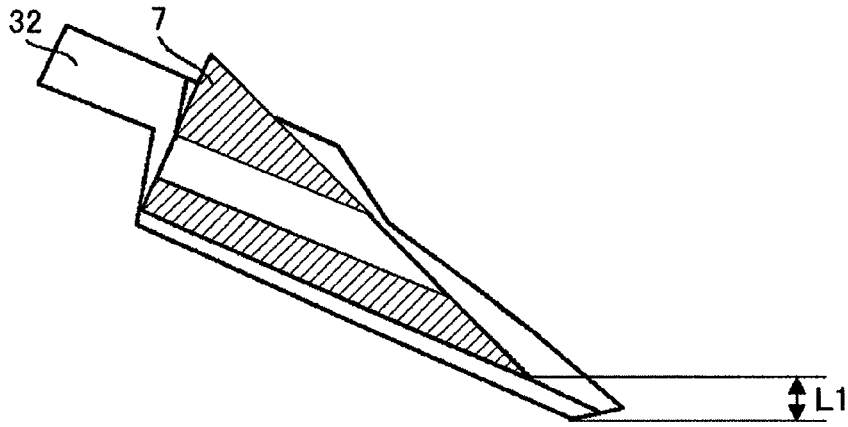
FIG. 9 is a drawing illustrating a positional relationship between a nozzle and a separating part.

As shown in FIG. 5, the nozzles 7 and the separating parts 32 are arranged alternately on a substrate (stay) 62 along its length direction. The nozzles 7, the separating parts 32, and the substrate 62 constitute an air separating mechanism. As shown in FIG. 6, the nozzles 7 and the separating parts 32 are connected to each other by joining the pins 59 and the pins 60 when they are mounted on the substrate 62. FIG. 7 shows a pair of the nozzle 7 and the separating part 32 seen from the side (in the length direction of the substrate 62 that is orthogonal to the paper conveying direction). As shown in FIG. 7, the separating part 32 is disposed lower than the nozzle 7. In other words, when a virtual plane on which paper is supposed to be conveyed from the nip toward the exit of the fusing unit 25 is called a paper conveying plane, the separating part 32 is disposed closer to the paper conveying plane than the nozzle 7. With this configuration, even if paper contacts the separating part 32 as shown in FIG. 8 and the separating part 32 is slightly displaced, the paper does not contact the nozzle 7. For this purpose, a distance difference L1 is set between the nozzle 7 and the separating part 32 as shown in FIG. 9. The distance difference L1 indicates the difference between the distance from the nozzle 7 to the paper conveying plane and the distance from the separating part 32 to the paper conveying plane. The distance difference L1 may instead be defined as the difference between the heights of the nozzle 7 and the separating part 32. Also, the separating part 32 protrudes beyond the tip (i.e., one end of the nozzle 7 from which compressed air is jetted) of the nozzle 7 toward the nip. The nozzles 7 and the separating parts 32 are not necessarily connected to each other via the pins 59 and 60. Instead, a gap adjustment mechanism may be provided for each of the nozzles 7 and the separating parts 32 to maintain the distance difference L1. For example, a gap adjustment mechanism may be provided near a hinged support (or a rotational axis) of the nozzle 7 or the separating part 32 and may be implemented as a rotational position adjustment mechanism that includes an elastic part such as a spring and a screw for compressing or extending the elastic part. The rotational position adjustment mechanism enables adjusting the rotational position of the tip of the nozzle 7 or the separating part 32 by turning the screw and thereby makes it possible to maintain the distance difference L1 at which paper does not contact the nozzle 7 even if the paper contacts and displaces the separating part 32.

When compressed air is not being jetted from the nozzles 7, the separating parts 32 function as a separating plate. The air separating mechanism as described above is suitable to separate paper having a small basis weight and carrying a large amount of unfused toner from the fusing roller 26. When separating paper having a large basis weight from the fusing roller 26, compressed air may not be jetted from the nozzles 7 and the paper may be separated from the fusing roller 26 using only the separating parts 32. To supply compressed air, any commercially-available compressor or a pump may be used.

The gap between the fusing roller 26 and the separating parts 32 is set at, for example, about 0.1 mm to about 0.6 mm. Meanwhile, the gap between the fusing roller 26 and the nozzles 7 is set at, for example, about 0.6 mm to about 1.0 mm. As the gap between the fusing roller 26 and the separating parts 32 decreases, the performance of the separating parts 32 in separating paper from the fusing roller 26 improves. Meanwhile, results of flow simulation and experiments show that if the nozzles 7 are placed too close to the fusing roller 26, the fusing roller 26 acts as resistance to jetted compressed air and it becomes difficult to supply a sufficient amount of compressed air to paper and to effectively separate the paper from the fusing roller 26. Therefore, it is preferable to provide a gap of about 0.6 mm to about 1.0 mm between the fusing roller 26 and the nozzles 7. In this embodiment, to set different gaps between the fusing roller 26 and the separating parts 32 and between the fusing roller 26 and the nozzles 7, the nozzles 7 and the separating parts 32 are arranged alternately along the length direction of the fusing roller 26 that is orthogonal to the paper conveying direction.

Figure 10:
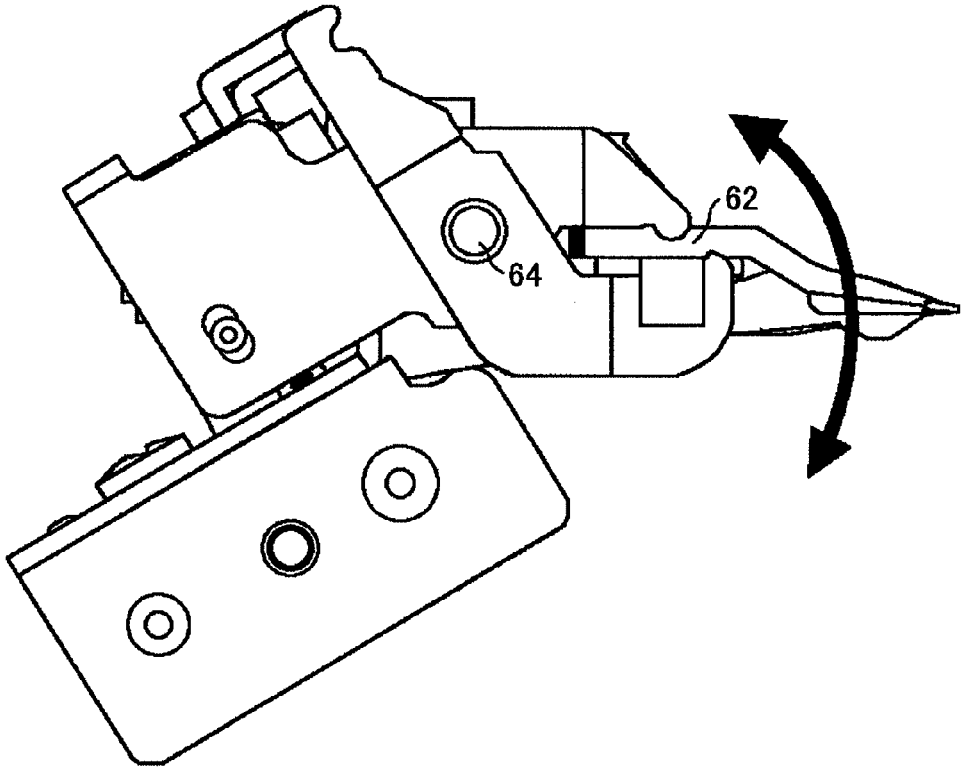
FIG. 10 is a drawing illustrating angle adjustment of an air separating mechanism.

As shown in FIG. 10, the substrate (stay) 62 may be configured to be rotated about a positioning pin 64. The rotational angle of the substrate 62 is adjusted such that compressed air is jetted at an optimum angle to most effectively separate paper from the fusing roller 26. Compressed air is preferably jetted from the air outlet 55 of the nozzle 7 such that the jetted compressed air reaches the leading edge of paper at the exact timing when the paper is conveyed to the exit of the nip and about to be separated from the fusing roller 26. In practice, compressed air is jetted before the paper exits the nip.

Figure 11:
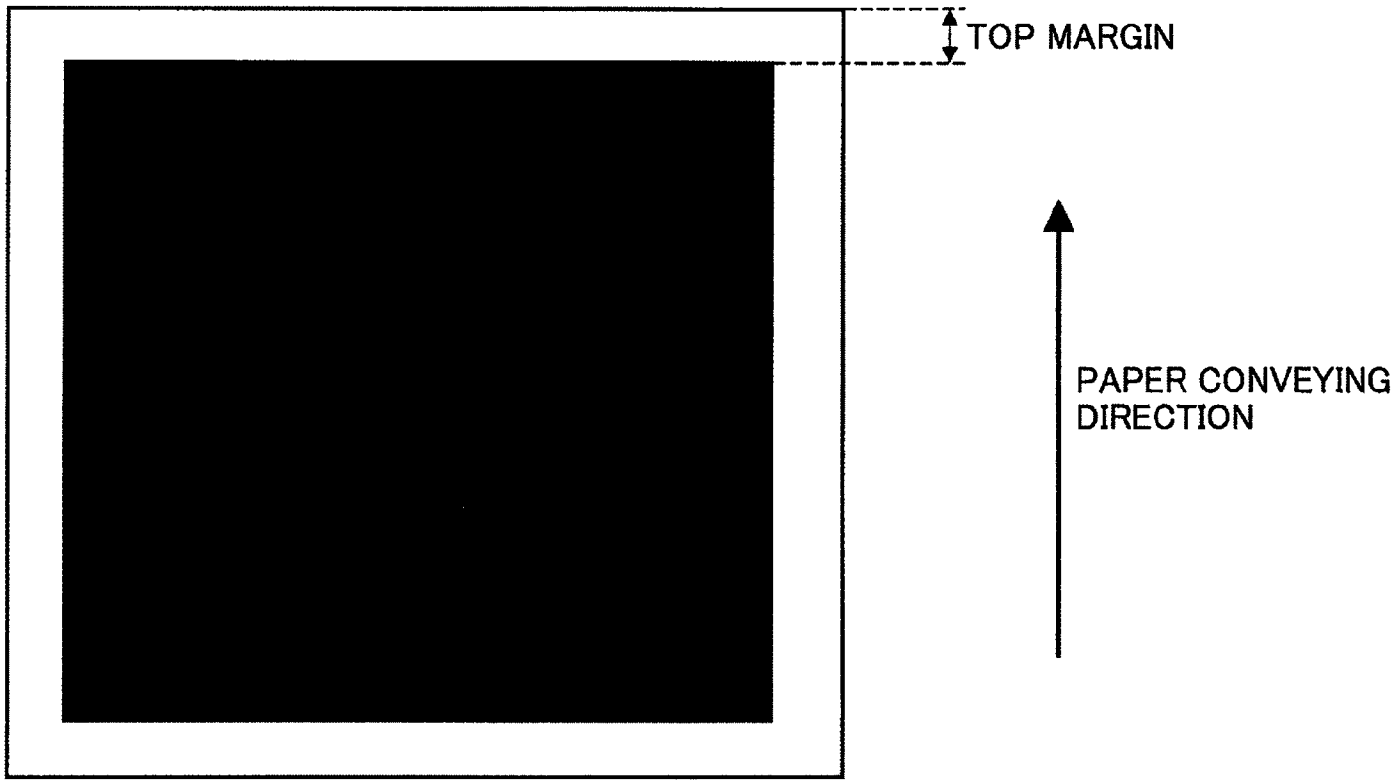
FIG. 11 is a drawing illustrating paper carrying toner.

An experiment was conducted using the air separating mechanism as described above. In the experiment, a large amount of unfused toner was transferred onto paper having a small basis weight (e.g., 45 kg) and the top margin of the paper was set at 2 mm as shown in FIG. 11. The air separating mechanism was able to stably separate the paper from the fusing roller. Compared with a related-art separating mechanism using a noncontact separating plate or a separating claw that can only separate paper with a top margin of 4 to 5 mm or more, the air separating mechanism of this embodiment has an excellent capability to separate paper from a fusing roller.

Figure 12:
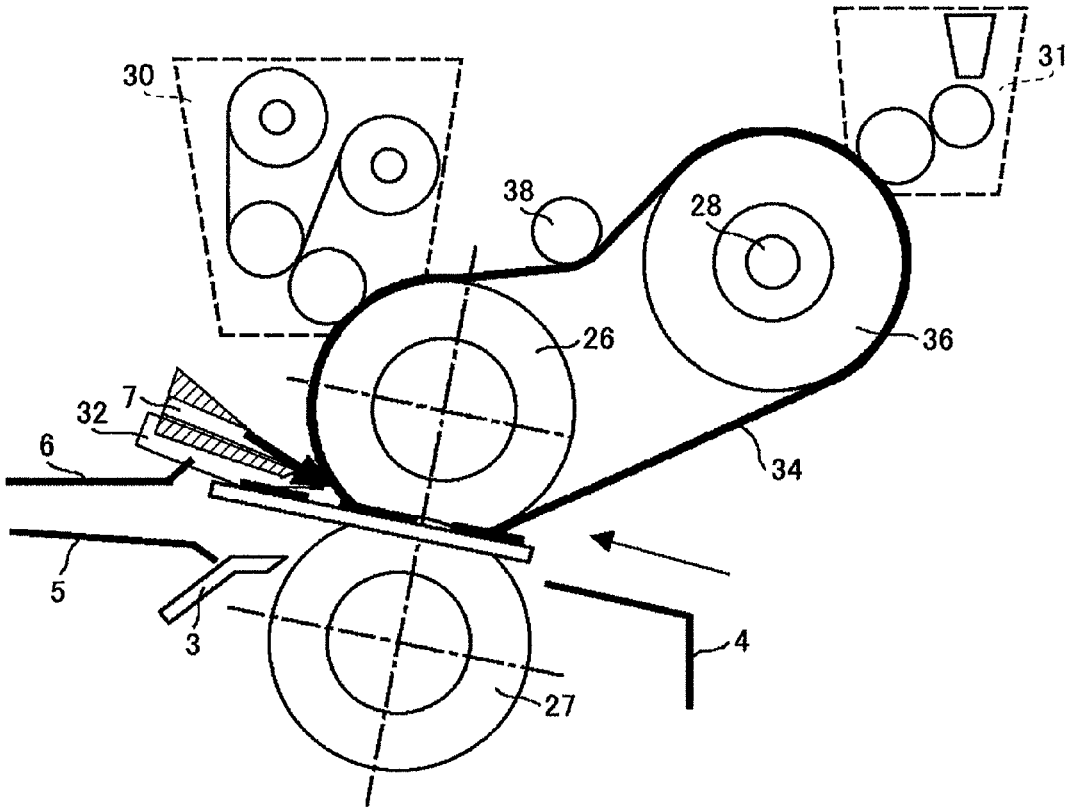
FIG. 12 is a schematic diagram of a belt fusing unit including an air separating mechanism.

FIG. 12 is a schematic diagram of a belt fusing unit (belt fusing device) including an air separating mechanism. The belt fusing unit includes a fusing belt 34 used as a fusing part. The fusing belt 34 is rotatably stretched over a fusing roller 26 that is a drive roller and a heating roller 36 that is a driven roller. A pressure roller 27 is disposed to face the fusing roller 26 via the fusing belt 34 and pressed against the pressure roller 26 via the fusing belt 34 by a pressing mechanism (not shown). A fusing heater 28 used as a heat source is provided inside of the heating roller 36. The heating roller 36 is heated by the fusing heater 28, and the fusing belt 34 is heated by the heating roller 36. A tension roller 38 is provided to increase the contact area of the fusing belt 34 with the heating roller 36 and thereby to increase the amount of heat transferred from the heating roller 36 to the fusing belt 34. The fusing roller 26 is rotated by a drive mechanism (not shown), the fusing belt 34 is rotated by the rotation of the fusing roller 26, and the pressure roller 27 is rotated by the fusing belt 34. The pressure roller 27 may also be rotated by a drive mechanism. A temperature sensor (not shown) detects the surface temperature of the fusing belt 34 and a temperature control unit (not shown) controls the fusing heater 28 based on an output signal from the temperature sensor to maintain the surface temperature of the fusing belt 34 at a predetermined temperature. Paper with an unfused toner image is conveyed into the belt fusing unit. In the belt fusing unit, the paper passes through a nip between the pressure roller 27 and the fusing belt 34 maintained at the predetermined temperature and as a result, the toner image is fused onto the paper. Thereafter, the paper is conveyed out of the belt fusing unit. The belt fusing unit may be used instead of the roller fusing unit 25 of the image forming apparatus of the above embodiment.

An aspect of this disclosure makes it possible to provide a fusing device with a separating mechanism including separating parts and nozzles that do not compromise the performance of each other and thereby makes it possible to effectively separate paper from a fusing roller or belt.

According to an embodiment of the present invention, a fusing device includes a rotary fusing part; a heating unit heating the rotary fusing part; a rotary pressure part pressed against the rotary fusing part; nozzles jetting compressed air to paper being conveyed through a nip between the rotary fusing part and the rotary pressure part; and separating parts guiding the paper separated from the rotary fusing part. The nozzles and the separating parts are disposed downstream of the nip in a paper conveying direction so as not to contact the rotary fusing part and the rotary pressure part and are arranged alternately along a length direction of the nip that is orthogonal to the paper conveying direction. The separating parts protrude beyond the tips of the nozzles toward the nip. With this configuration, even if paper contacts the separating parts, the paper does not contact the nozzles. Therefore, this configuration makes it possible to prevent toner from adhering to the nozzles. This configuration also makes it possible to reduce stress applied to the nozzles and the separating parts and thereby to improve their durability. Further, since the nozzles and the separating parts are provided separately from each other, it is easy to change the shapes of the nozzles and the separating parts and to coat the surfaces of the nozzles and the separating parts.

The fusing device may also include a substrate on which the nozzles and the separating parts are mounted. The substrate is rotatable around a rotational axis to adjust the direction in which the compressed air is jetted. This configuration makes it possible to jet compressed air at an optimum angle to most effectively separate the paper from the rotary fusing part, and thereby makes it possible to reduce the frequency of paper jams and to stably convey paper. Reducing the frequency of paper jams in turn makes it possible to reduce stress applied to the nozzles and the separating parts. The separating parts may be disposed closer to a paper conveying plane than the nozzles. This configuration makes it possible to prevent paper from contacting the nozzles even if the paper contacts and displaces the separating parts. For this purpose, a distance difference between the distance from the nozzles to the paper conveying plane and the distance from the separating parts to the paper conveying plane is determined such that the paper does not contact the nozzles even if the paper contacts and displaces the separating parts.

Each of the nozzles may include an air outlet jetting the compressed air and protective walls surrounding the air outlet on three sides. The protective walls prevent toner scattered by the compressed air from adhering to the air outlet and thereby makes it possible to stably jet compressed air. The fusing device may also include a cleaning unit cleaning the rotary fusing part or an oil applying unit applying oil to the rotary fusing part. This configuration makes it easier to separate the paper from the rotary fusing part by jetting compressed air to the paper and thereby makes it possible to prevent toner from adhering to the separating parts and to stably convey the paper. The surfaces of the nozzles may be coated with fluoroplastic or the nozzles may include fluoroplastic. This configuration improves toner-release characteristics of the nozzles and makes it possible to prevent toner from adhering to the nozzles even when a paper jam occurs. This in turn makes it possible to reduce the need to clean the nozzles.

The present invention is not limited to the specifically disclosed embodiments, and variations and modifications may be made without departing from the scope of the present invention.

The present application is based on Japanese Priority Application No. 2010-001897, filed on Jan. 7, 2010, the entire contents of which are hereby incorporated herein by reference.

What is claimed is:

1. A fusing device, comprising:

a rotary fusing part;

a heating unit heating the rotary fusing part;

a rotary pressure part pressed against the rotary fusing part;

nozzles jetting compressed air to paper being conveyed through a nip between the rotary fusing part and the rotary pressure part; and separating parts guiding the paper separated from the rotary fusing part, wherein the nozzles and the separating parts are disposed downstream of the nip in a paper conveying direction so as not to contact the rotary fusing part and the rotary pressure part, wherein the nozzles and the separating parts are arranged alternately and spaced from each other along a length direction of the nip that is orthogonal to the paper conveying direction, and wherein the separating parts protrude beyond tips of the nozzles toward the nip.

2. The fusing device as claimed in claim 1, further comprising:

a substrate on which the nozzles and the separating parts are mounted, wherein the substrate is rotatable around a rotational axis to adjust a direction in which the compressed air is jetted.

3. The fusing device as claimed in claim 1, wherein the separating parts are disposed closer to a paper conveying plane than the nozzles.

4. The fusing device as claimed in claim 3, wherein a distance difference between a distance from the nozzles to the paper conveying plane and a distance from the separating parts to the paper conveying plane is determined such that the paper does not contact the nozzles even if the paper contacts and displaces the separating parts.

5. The fusing device as claimed in claim 1, wherein each of the nozzles includes an air outlet jetting the compressed air and protective walls surrounding the air outlet on three sides.

6. The fusing device as claimed in claim 1, further comprising:

a cleaning unit cleaning the rotary fusing part.

7. The fusing device as claimed in claim 1, further comprising:

an oil applying unit applying oil to the rotary fusing part.

8. The fusing device as claimed in claim 1, wherein surfaces of the nozzles are coated with fluoroplastic.

9. The fusing device as claimed in claim 1, wherein the nozzles include fluoroplastic.

10. An image forming apparatus comprising the fusing device of claim 1.

11. A fusing device, comprising:

a rotary fusing part;

a heating unit heating the rotary fusing part;

a rotary pressure part pressed against the rotary fusing part;

nozzles jetting compressed air to paper being conveyed through a nip between the rotary fusing part and the rotary pressure part; and separating parts configured to function as a paper guide for guiding the paper separated by the compressed air from the rotary fusing part when the compressed air is being jetted from the nozzles and function as a separating plate for separating the paper from the rotary fusing part when the compressed air is not being jetted from the nozzles, wherein the nozzles and the separating parts are disposed downstream of the nip in a paper conveying direction so as not to contact the rotary fusing part and the rotary pressure part, wherein the nozzles and the separating parts are arranged alternately along a length direction of the nip that is orthogonal to the paper conveying direction, and wherein the separating parts protrude beyond tips of the nozzles toward the nip.

12. The fusing device as claimed in claim 11, further comprising:

a substrate on which the nozzles and the separating parts are mounted, wherein the substrate is rotatable around a rotational axis to adjust a direction in which the compressed air is jetted.

13. The fusing device as claimed in claim 11, wherein the separating parts are disposed closer to a paper conveying plane than the nozzles.

14. The fusing device as claimed in claim 13, wherein a distance difference between a distance from the nozzles to the paper conveying plane and a distance from the separating parts to the paper conveying plane is determined such that the paper does not contact the nozzles even if the paper contacts and displaces the separating parts.

15. The fusing device as claimed in claim 11, wherein each of the nozzles includes an air outlet jetting the compressed air and protective walls surrounding the air outlet on three sides.

16. The fusing device as claimed in claim 11, further comprising:

a cleaning unit cleaning the rotary fusing part.

17. The fusing device as claimed in claim 11, further comprising:

an oil applying unit applying oil to the rotary fusing part.

18. The fusing device as claimed in claim 11, wherein surfaces of the nozzles are coated with fluoroplastic.

19. The fusing device as claimed in claim 11, wherein the nozzles include fluoroplastic.

20. An image forming apparatus comprising the fusing device of claim 11.

* * * * *